US011384774B2

(12) United States Patent
Hayashi et al.

(10) Patent No.: US 11,384,774 B2
(45) Date of Patent: Jul. 12, 2022

(54) ROTOR AND CENTRIFUGAL COMPRESSOR INCLUDING THE SAME

(71) Applicant: MITSUBISHI HEAVY INDUSTRIES ENGINE & TURBOCHARGER, LTD., Sagamihara (JP)

(72) Inventors: Yoshihiro Hayashi, Tokyo (JP); Yutaka Fujita, Tokyo (JP); Nobuhito Oka, Sagamihara (JP); Koichi Takahashi, Sagamihara (JP); Hayato Nishi, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 17/048,247

(22) PCT Filed: Jun. 11, 2018

(86) PCT No.: PCT/JP2018/022178
§ 371 (c)(1),
(2) Date: Oct. 16, 2020

(87) PCT Pub. No.: WO2019/239451
PCT Pub. Date: Dec. 19, 2019

(65) Prior Publication Data
US 2021/0164487 A1 Jun. 3, 2021

(51) Int. Cl.
*F04D 29/28* (2006.01)
*F04D 17/10* (2006.01)

(52) U.S. Cl.
CPC ..... *F04D 29/284* (2013.01); *F04D 17/10* (2013.01)

(58) Field of Classification Search
CPC ..... F04D 29/284; F04D 17/10; F04D 29/30; F05D 2240/307; F05D 2250/292
See application file for complete search history.

(56) References Cited

U.S. PATENT DOCUMENTS 6,340,291 B1 1/2002 Reckert
2005/0260074 A1 11/2005 Higashimori
(Continued)

FOREIGN PATENT DOCUMENTS

CN 1771397 A 5/2006
CN 103261699 A 8/2013
(Continued)

OTHER PUBLICATIONS

International Preliminary Report on Patentability and Written Opinion of the International Searching Authority with an English translation, dated Dec. 24, 2020, for International Application No. PCT/JP2018/022178.
(Continued)

*Primary Examiner* — Audrey B. Walter
*Assistant Examiner* — Edward Bushard
(74) *Attorney, Agent, or Firm* — Birch, Stewart, Kolasch & Birch, LLP

(57) ABSTRACT

A rotor includes: a hub; and a plurality of blades disposed on the hub. Each of the plurality of blades includes a suction surface, a pressure surface, a leading edge, a trailing edge, a tip-side edge, and a hub-side edge. In a cross-section of each blade at a given chord position between the leading edge and the trailing edge, an angle of at least one of the suction surface or the pressure surface with respect to a blade height direction of the blade increases in a direction from the hub-side edge to the tip-side edge over a region from the hub-side edge to the tip-side edge, in at least a range from the leading edge to a chord position away from the leading edge toward the trailing edge.

6 Claims, 4 Drawing Sheets

(56) References Cited

U.S. PATENT DOCUMENTS

| | | | | |
|---|---|---|---|---|
| 2013/0272861 | A1 | 10/2013 | Tomita et al. | |
| 2015/0204195 | A1 | 7/2015 | Klaus et al. | |
| 2017/0335858 | A1* | 11/2017 | Okabe ..... | F02B 39/00 |

FOREIGN PATENT DOCUMENTS

| | | | |
|---|---|---|---|
| CN | 133256248 | A | 8/2013 |
| CN | 104471190 | A | 3/2015 |
| CN | 107110176 | A | 8/2017 |
| JP | 57-163200 | A | 10/1982 |
| JP | 58-119998 | A | 7/1983 |
| JP | 2005-307967 | A | 11/2005 |
| JP | 2012-137067 | A | 7/2012 |
| JP | 2016-17461 | A | 2/2016 |

OTHER PUBLICATIONS

International Search Report, dated Sep. 4, 2018, for International Application No. PCT/JP2018/022178, with an English translation.
Chinese Office Action and Search Report for Chinese Application No. 201880089078.1, dated Feb. 26, 2021, with English translation.
Extended European Search Report for corresponding European Application No. 18922482.7, dated May 26, 2621.

* cited by examiner

ROTOR AND CENTRIFUGAL COMPRESSOR INCLUDING THE SAME

TECHNICAL FIELD

The present disclosure relates to a rotor and a centrifugal compressor including the rotor.

BACKGROUND

In a centrifugal compressor of a turbocharger, when the natural frequency of an impeller is equal to the frequency of excitation caused by a fluid flowing in the centrifugal compressor, resonance may occur and increase the vibration of the impeller, which may lead to damage to the impeller. In order to improve the safety against such resonance, it is conceivable to partially decrease the blade thickness at the portion corresponding to the anti-node of the eigenmode and increase the blade thickness at the portion corresponding to the node of the eigenmode. For achieving such a shape, it is necessary to three-dimensionally define the blade thickness distribution of the blade.

In Patent Document 1, not for improving the safety against resonance but for extending the operating range of the centrifugal compressor at the high flow rate side, the blade of the impeller is divided in the blade height direction into a tip portion on the tip side, a root portion on the hub side, and a connection portion between the tip portion and the root portion, with the blade thickness of the tip portion constant and thinner than the blade thickness of the root portion, the blade thickness of the connection portion gradually decreasing from the root portion toward the tip portion, and the blade thickness of the root portion gradually decreasing toward the connection portion.

CITATION LIST

Patent Literature

Patent Document 1: JP2016-17461A

SUMMARY

Problems to be Solved

However, as can be seen from FIG. 4 showing results of eigenvalue analysis of the blade by the present inventors, the anti-node portion of the first eigenmode of the blade 100 is located in a range of 50 to 100% of the blade height from the hub-side edge 102 to the tip-side edge 103 of the blade 100 on the leading edge 101 side of the blade 100. Accordingly, in the blade thickness distribution of the blade described in Patent Document 1, although the blade thickness can be partially decreased at the portion corresponding to the anti-node of the eigenmode, the blade thickness cannot be appropriately increased at the portion corresponding to the node of the eigenmode, so that it may not be possible to improve the safety against resonance. Further, due to the portion where the blade thickness distribution is concave from the hub side to the tip side, the machining method for forming the blade surface is limited.

In view of the above, an object of at least one embodiment of the present disclosure is to provide a rotor and a centrifugal compressor including the rotor whereby it is possible to improve the safety against resonance.

Solution to the Problems (1) A rotor according to at least one embodiment of the present invention comprises: a hub; and a plurality of blades disposed on the hub. Each of the plurality of blades includes a suction surface, a pressure surface, a leading edge, a trailing edge, a tip-side edge, and a hub-side edge. In a cross-section of each blade at a given chord position between the leading edge and the trailing edge, an angle of at least one of the suction surface or the pressure surface with respect to a blade height direction of the blade increases in a direction from the hub-side edge to the tip-side edge over a region from the hub-side edge to the tip-side edge, in at least a range from the leading edge to a chord position away from the leading edge toward the trailing edge.

With the above configuration (1), since, in a cross-section of each blade at a given chord position between the leading edge and the trailing edge, the angle of at least one of the suction surface or the pressure surface with respect to the blade height direction of the blade increases in the direction from the hub-side edge to the tip-side edge over the region from the hub-side edge to the tip-side edge, in at least a range from the leading edge to a chord position away from the leading edge toward the trailing edge, the blade thickness of the portion corresponding to the anti-node of the eigenmode is partially decreased, and the blade thickness of the portion corresponding to the node of the eigenmode is increased. Thus, it is possible to improve the safety against resonance.

(2) In some embodiments, in the above configuration (1), the at least one of the suction surface or the pressure surface includes a first region from the leading edge to a chord position away from the leading edge toward the trailing edge, and a second region on a trailing edge side of the first region. In the first region, the angle increases continuously from the hub-side edge to the tip-side edge.

With the above configuration (2), although the first region requires point cutting which may increase the processing time and manufacturing cost of the blade, since the first region is a partial region in the vicinity of the leading edge, it is possible to suppress an increase in processing time and manufacturing cost of the blade, as compared with the case where the entire blade surface is formed by point cutting.

(3) In some embodiments, in the above configuration (2), the second region is composed of at least two line segments between the tip-side edge and the hub-side edge.

With the above configuration (3), since the second region can be machined by line cutting, even when the configuration in which the angle with respect to the blade height direction of the blade increases in the direction from the hub-side edge to the tip-side edge over the region from the hub-side edge to the tip-side edge is formed on the trailing edge side of the first region, it is possible to suppress an increase in processing time and manufacturing cost of the blade.

(4) In some embodiments, in the above configuration (2) or (3), the first region is in a range between the leading edge and a 5% to 15% chord position from the leading edge.

Generally, the range between the leading edge and the 5% to 15% chord position requires point cutting to round the leading edge of the blade. With the above configuration (4), by machining the blade surface shape of the first region at the time of rounding the leading edge of the blade, it is possible to suppress an increase in processing time and manufacturing cost of the blade, as compared with the case where the point cutting process is performed only for machining the blade surface shape of the first region.

(5) In some embodiments, in any one of the above configurations (1) to (4), the angle of one of the suction surface or the pressure surface with respect to the blade height direction of the blade increases in the direction from the hub-side edge to the tip-side edge over the region from the hub-side edge to the tip-side edge, in at least the range between the leading edge and the chord position away from the leading edge toward the trailing edge, and the other of the suction surface or the pressure surface forms a line segment connecting the hub-side edge and the tip-side edge.

With the above configuration (5), since only one of the suction surface or the pressure surface is machined so that the angle with respect to the blade height direction of the blade increases in the direction from the hub-side edge to the tip-side edge over the region from the hub-side edge to the tip-side edge, it is possible to suppress an increase in processing time and manufacturing cost of the blade, as compared with the case where both the suction surface and the pressure surface are machined as described above. Further, since the other of the suction surface or the pressure surface is a flat surface connecting the hub-side edge and the tip-side edge, it is possible to reliably achieve the blade thickness distribution in which the blade thickness of the portion corresponding to the anti-node of the eigenmode is partially decreased, and the blade thickness of the portion corresponding to the node of the eigenmode is increased.

(6) A centrifugal compressor according to at least one embodiment of the present invention comprises: the rotor described in any one of the above (1) to (5).

With the above configuration (6), it is possible to improve the safety against resonance.

Advantageous Effects

According to at least one embodiment of the present disclosure, since, in a cross-section of each blade at a given chord position between the leading edge and the trailing edge, the angle of at least one of the suction surface or the pressure surface with respect to the blade height direction of the blade increases in the direction from the hub-side edge to the tip-side edge over the region from the hub-side edge to the tip-side edge, in at least a range from the leading edge to a chord position away from the leading edge toward the trailing edge, the blade thickness of the portion corresponding to the anti-node of the eigenmode is partially decreased, and the blade thickness of the portion corresponding to the node of the eigenmode is increased. Thus, it is possible to improve the safety against resonance.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A rotor according to some embodiments of the present disclosure will be described by taking a rotor (impeller) provided in a centrifugal compressor of a turbocharger as an example. However, the centrifugal compressor of the present disclosure is not limited to a centrifugal compressor of a turbocharger, and may be any centrifugal compressor which operates alone. Further, although not described specifically, the rotor of the present disclosure includes a rotor used for a turbine or an axial-flow pump.

Figure 1:
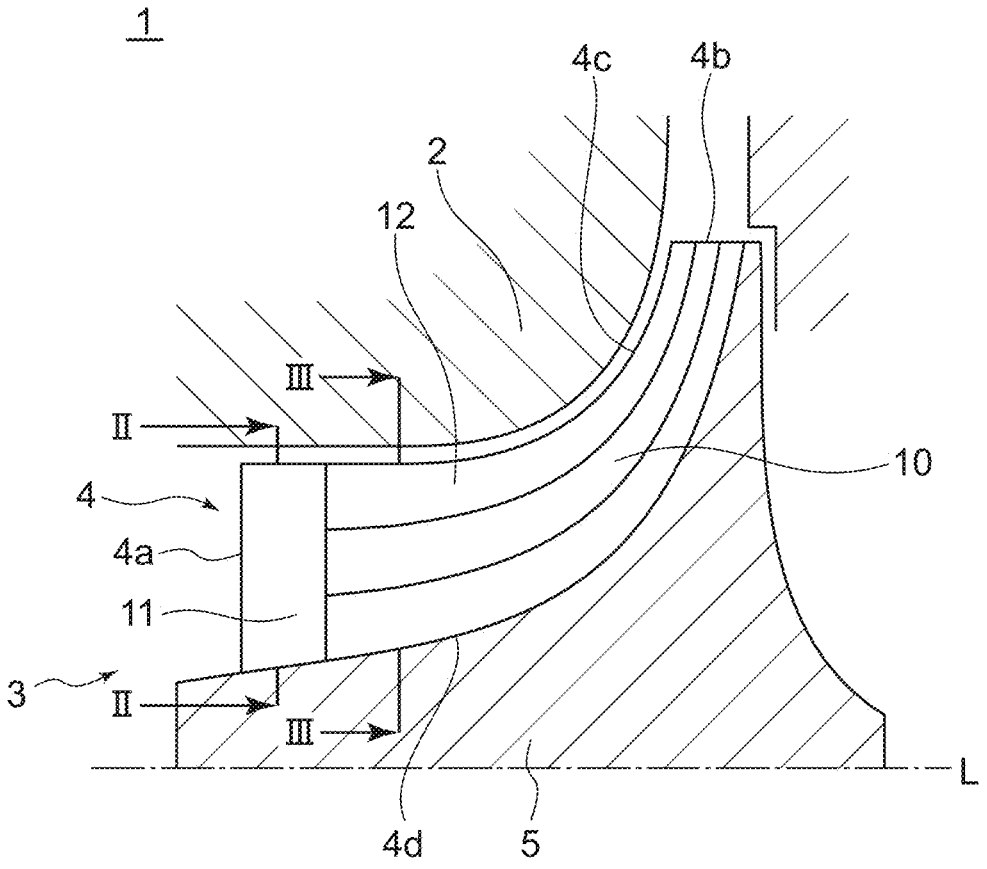
FIG. 1 is a partial cross-sectional view of a centrifugal compressor including a rotor according to an embodiment of the present disclosure.

As shown in FIG. 1, the centrifugal compressor 1 includes a housing 2 and an impeller 3 rotatably disposed around the rotational axis L within the housing 2. The impeller 3 has a plurality of blades 4 (only one blade 4 is depicted in FIG. 1) of streamlined shape arranged on the hub 5 at a predetermined interval in the circumferential direction. Each blade 4 includes a leading edge 4*a*, a trailing edge 4*b*, a tip-side edge 4*c* facing the housing 2, and a hub-side edge 4*d* connected to the hub 5.

The suction surface 10 of the blade 4 is divided into a first region 11 ranging from the leading edge 4*a* to a chord position away from the leading edge 4*a* toward the trailing edge 4*b* and a second region 12 on the trailing edge 4*b* side of the first region 11. Although not depicted in FIG. 1, the pressure surface of the blade 4 is also divided into the first region 11 and the second region 12.

Figure 2:
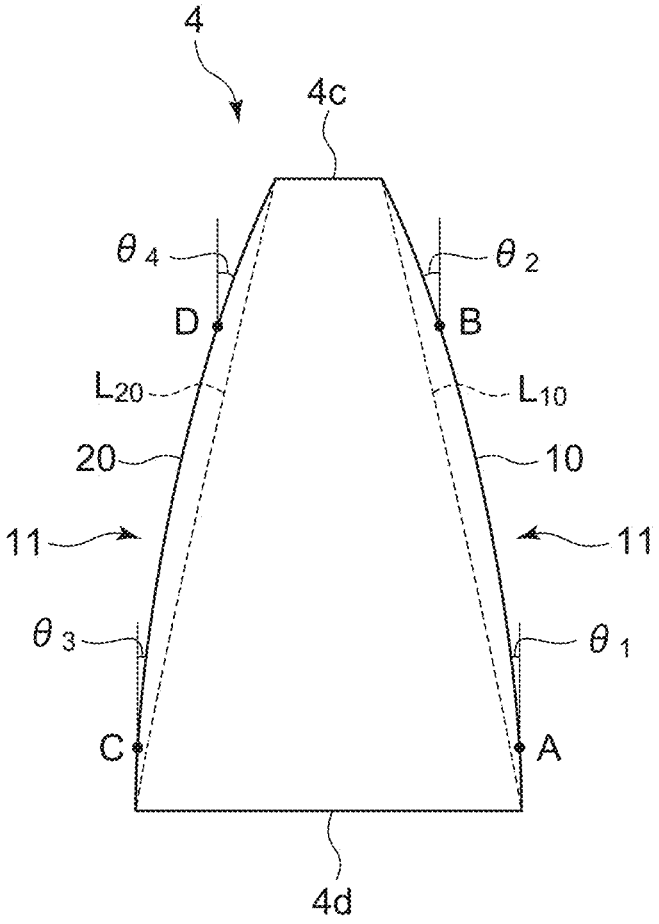
FIG. 2 is a cross-sectional view taken along line II-II in FIG. 1.

FIG. 2 shows a cross-section obtained by cutting the blade 4 at a given chord position in the first region 11 of each of the suction surface 10 and the pressure surface 20 of the blade 4 (hatching is omitted). Both the suction surface 10 and the pressure surface 20 are curved convexly with respect to line segments $L_{10}$ and $L_{20}$ which connects the tip-side edge 4*c* and the hub-side edge 4*d* in the cross-section.

In the cross-section shown in FIG. 2, the convex curve in the first region 11 of the suction surface 10 is shaped such that the angle with respect to the blade height direction of the blade 4 increases in a direction from the hub-side edge 4*d* to the tip-side edge 4*c* over a region from the hub-side edge 4*d* to the tip-side edge 4*c*. That is, $\theta_1<\theta_2$ is established, where $\theta_1$ is an angle with respect to the blade height direction of the blade 4 at the position A closer to the hub-side edge 4*d* than the tip-side edge 4*c*, and 02 is an angle with respect to the blade height direction of the blade 4 at the position B closer to the tip-side edge 4*c* than the position A.

In the cross-section shown in FIG. 2, similarly, the convex curve in the first region 11 of the pressure surface 20 is shaped such that the angle with respect to the blade height direction of the blade 4 increases in a direction from the hub-side edge 4*d* to the tip-side edge 4*c* over a region from the hub-side edge 4*d* to the tip-side edge 4*c*. That is, $\theta_3<\theta_4$ is established, where $\theta_3$ is an angle with respect to the blade height direction of the blade 4 at the position C closer to the hub-side edge 4*d* than the tip-side edge 4*c*, and $\theta_4$ is an angle with respect to the blade height direction of the blade 4 at the position D closer to the tip-side edge 4*c* than the position C.

Figure 3:
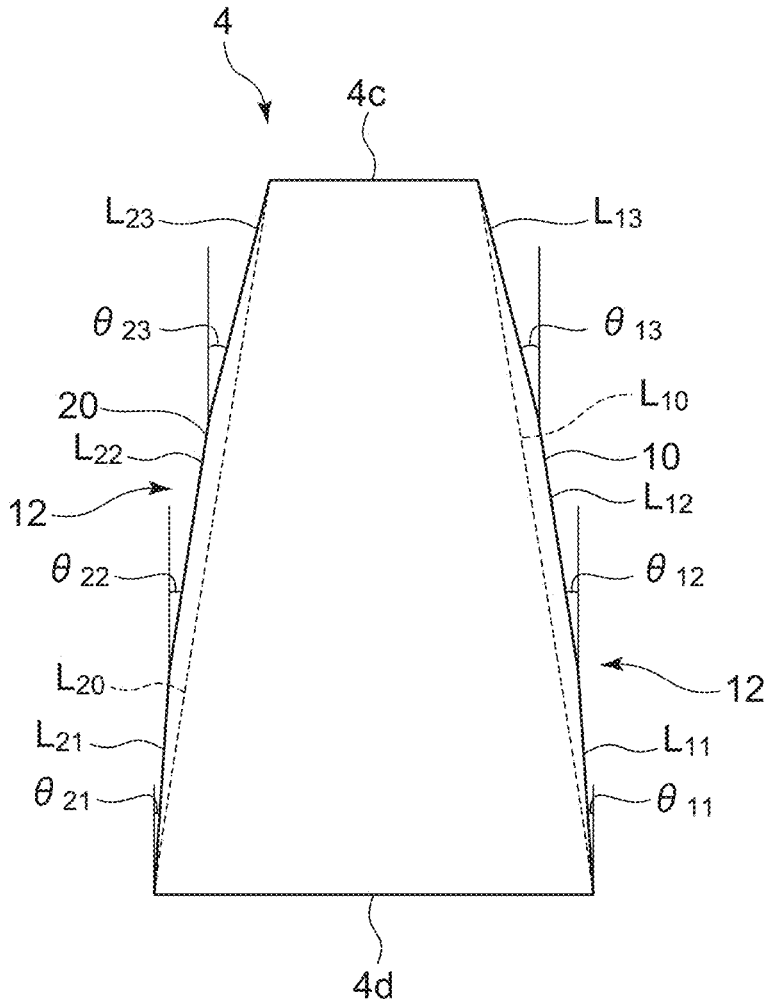
FIG. 3 is a cross-sectional view taken along line in FIG. 1.
Figure 4:
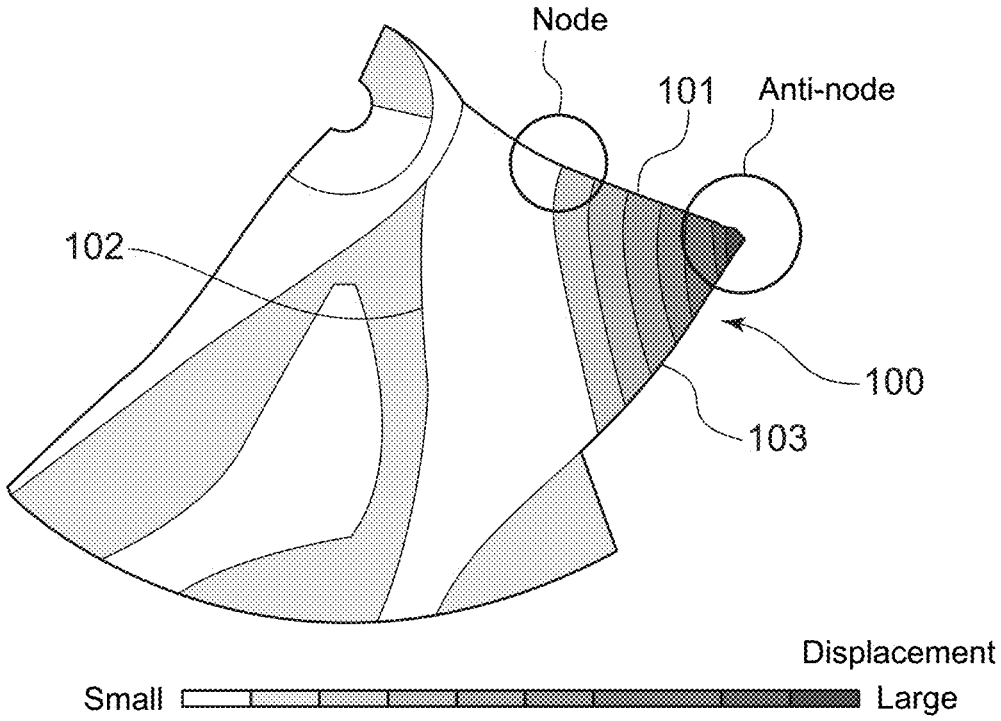
FIG. 4 is a diagram showing results of eigenvalue analysis of a blade by the present inventors.

FIG. 3 shows a cross-section obtained by cutting the blade 4 at a given chord position in the second region 12 of each of the suction surface 10 and the pressure surface 20 of the blade 4 (hatching is omitted). The suction surface 10 has a shape composed of three line segments $L_{11}$, $L_{12}$, $L_{13}$ sequentially connected in the cross-section. Similarly, the pressure surface 20 has a shape composed of three line segments $L_{21}$, $L_{22}$, $L_{23}$ sequentially connected in the cross-section. As a result, the suction surface 10 and the pressure surface 20 protrude from the line segments $L_{10}$ and $L_{20}$, respectively In the cross-section shown in FIG. 3, the second region 12 of the suction surface 10 is shaped so as to satisfy $\theta_{11}<\theta_{12}<\theta_{13}$, where $\theta_{11}$, $\theta_{12}$, and $\theta_{13}$ are angles between each line segment $L_{11}$, $L_{12}$, $L_{13}$ and the blade height direction of the blade 4. That is, the second region 12 of the suction surface 10 is also shaped such that the angle with respect to the blade height direction of the blade 4 increases in the direction from the hub-side edge 4*d* to the tip-side edge 4*c* over the region from the hub-side edge 4*d* to the tip-side edge 4*c*, not continuously but stepwise.

In the cross-section shown in FIG. 3, the second region 12 of the pressure surface 20 is shaped so as to satisfy $\theta_{21}<\theta_{22}<\theta_{23}$, where $\theta_{21}$, $\theta_{22}$, and $\theta_{23}$ are angles between each line segment $L_{21}$, $L_{22}$, $L_{23}$ and the blade height direction of the blade 4. That is, the second region 12 of the pressure surface 20 is also shaped such that the angle with respect to the blade height direction of the blade 4 increases in the direction from the hub-side edge 4*d* to the tip-side edge 4*c* over the region from the hub-side edge 4*d* to the tip-side edge 4*c*, not continuously but stepwise.

As described with reference to FIGS. 2 and 3, since the angles of both the suction surface 10 and the pressure surface 20 with respect to the blade height direction of the blade 4 increase in the direction from the hub-side edge 4*d* to the tip-side edge 4*c* over the region from the hub-side edge 4*d* to the tip-side edge 4*c*, the blade thickness of the portion in the vicinity of the tip-side edge 4*c* corresponding to the anti-node of the eigenmode is decreased to ensure an eigenvalue, and the blade thickness of about 50% blade height from the hub-side edge 4*d* to the tip-side edge 4*c* is increased to improve the strength of the portion corresponding to the node of the eigenmode. Thus, it is possible to improve the safety against resonance that may occur during operation of the centrifugal compressor 1 (see FIG. 1).

As shown in FIG. 3, the blade surface shape of the second region 12, whose cross-section obtained by cutting the blade 4 at a given chord position is composed of a plurality of line segments, can be formed by line cutting. Meanwhile, as shown in FIG. 2, the blade surface shape of the first region 11, whose cross-section obtained by cutting the blade 4 at a given chord position is composed of a continuous curve, cannot be formed by line cutting but requires point cutting. Although the point cutting process requires a longer processing time and a higher cost than the line cutting process, the first region 11 is limited to a partial region in the vicinity of the leading edge 4*a*. Thus, it is possible to suppress an increase in processing time and manufacturing cost of the blade 4, as compared with the case where the entire blade surface has the shape of the first region 11.

The first region 11 is preferably in a range between the leading edge 4*a* and a 5% to 15% chord position from the leading edge 4*a*. Generally, the range between the leading edge 4*a* and the 5% to 15% chord position from the leading edge 4*a* requires point cutting to round the leading edge 4*a* of the blade 4. By machining the blade surface of the first region 11 at the time of rounding the leading edge 4*a* of the blade 4, it is possible to suppress an increase in processing time and manufacturing cost of the blade 4, as compared with the case where the point cutting process is performed only for machining the blade surface of the first region 11.

In the above embodiment, the second region 12 has a shape such that three line segments are sequentially connected in the cross-section obtained by cutting the blade 4 at a given chord position, but the embodiment is not limited thereto. The second region 12 may have shape such that two or four or more line segments are sequentially connected.

In the above embodiment, the suction surface 10 and the pressure surface 20 have the blade surface shapes of the first region 11 and the second region 12 according to the same embodiment, but the embodiment is not limited thereto. The first region 11 of the suction surface 10 and the first region 11 of the pressure surface 20 may have different ranges. In this case, it is preferred that the range of the first region 11 of the suction surface 10 is larger than the range of the first region 11 of the pressure surface 20. This is because the pressure surface 20 has a thinner boundary layer than the suction surface 10, and separation is less likely to occur in response to a change in curvature of the wall surface, so that performance improvement can be expected.

In the above embodiment, the suction surface 10 and the pressure surface 20 both have the blade surface shapes of the first region 11 and the second region 12, but the embodiment is not limited thereto. Either one of the suction surface 10 or the pressure surface 20 may have the blade surface shapes of the first region 11 and the second region 12, and the other may be a flat surface connecting the hub-side edge 4*d* and the tip-side edge 4*c* (corresponding to line segment $L_{10}$ or $L_{20}$ in FIGS. 2 and 3). In this case, it is preferred that the pressure surface 20 have the blade surface shape of the second region 12, and the suction surface 10 is a flat surface connecting the hub-side edge 4*d* and the tip-side edge 4*c*. This is because the pressure surface 20 has a thinner boundary layer than the suction surface 10, and separation is less likely to occur in response to a change in curvature of the wall surface.

When the blade surface shapes of the first region 11 and the second region 12 are formed on one of the suction surface 10 or the pressure surface 20, it is possible to suppress an increase in processing time and manufacturing cost of the blade 4, as compared with the case where the blade surface shapes are formed on both the suction surface 10 and the pressure surface 20. Further, since the other of the suction surface 10 or the pressure surface 20 is a flat surface connecting the hub-side edge 4*d* and the tip-side edge 4*c*, it is possible to reliably achieve the blade thickness distribution in which the blade thickness of the portion corresponding to the anti-node of the eigenmode is partially decreased and the blade thickness of the portion corresponding to the node of the eigenmode is increased.

In the above embodiment, each of the suction surface 10 and the pressure surface 20 includes both the first region 11 and the second region 12, but each may include at least the first region 11. In the case where the second region 12 is included, the second region 12 may not extend in the entire region from the first region 11 to the trailing edge 4*b*, but may extend in a region from the first region 11 to a chord position away from the first region 11 toward the trailing edge 4*b*.

Although in the above embodiment, the blade 4 is a full blade, the blade is not limited thereto. The blade 4 may be a splitter blade disposed between two full blades.

REFERENCE SIGNS LIST

1 Centrifugal compressor
2 Housing
3 Impeller (Rotor)
4 Blade
4*a* Leading edge
4*b* Trailing edge
4*c* Tip-side edge
4*d* Hub-side edge
5 Hub
10 Suction surface
11 First region
12 Second region
20 Pressure surface L Rotational axis
$L_{10}$ Line segment
$L_{11}$ Line segment
$L_{12}$ Line segment
$L_{13}$ Line segment
$L_{20}$ Line segment
$L_{21}$ Line segment
$L_{22}$ Line segment
$L_{23}$ Line segment
$\theta_1$ Angle
$\theta_2$ Angle
$\theta_3$ Angle
$\theta_4$ Angle
$\theta_{11}$ On Angle
$\theta_{12}$ Angle
$\theta_{13}$ Angle
$\theta_{21}$ Angle
$\theta_{22}$ Angle
$\theta_{23}$ Angle

The invention claimed is:

1. A rotor, comprising:

a hub; and a plurality of blades disposed on the hub, wherein each of the plurality of blades includes a suction surface, a pressure surface, a leading edge, a trailing edge, a tip-side edge, and a hub-side edge, and wherein, in a cross-section of each blade at a given chord position between the leading edge and the trailing edge, an angle of at least one of the suction surface or the pressure surface with respect to a blade height direction of the blade increases in a direction from the hub-side edge to the tip-side edge over a region from the hub-side edge to the tip-side edge, in at least a range from the leading edge to a chord position away from the leading edge toward the trailing edge.

2. The rotor according to claim 1, wherein the at least one of the suction surface or the pressure surface includes a first region from the leading edge to a chord position away from the leading edge toward the trailing edge, and a second region on a trailing edge side of the first region, and wherein, in the first region, the angle increases continuously from the hub-side edge to the tip-side edge.

3. The rotor according to claim 2, wherein the second region is composed of at least two line segments between the tip-side edge and the hub-side edge.

4. The rotor according to claim 2, wherein the first region is in a range between the leading edge and a 5% to 15% chord position from the leading edge.

5. The rotor according to claim 1, wherein the angle of one of the suction surface or the pressure surface with respect to the blade height direction of the blade increases in the direction from the hub-side edge to the tip-side edge over the region from the hub-side edge to the tip-side edge, in at least the range between the leading edge and the chord position away from the leading edge toward the trailing edge, and the other of the suction surface or the pressure surface forms a line segment connecting the hub-side edge and the tip-side edge.

6. A centrifugal compressor, comprising the rotor according to claim 1.

* * * * *